US011821231B2

(12) United States Patent
Coelho

(10) Patent No.: US 11,821,231 B2
(45) Date of Patent: Nov. 21, 2023

(54) ROLLING COVER FOR A SPA

(71) Applicant: Masterspas, LLC, Fort Wayne, IN (US)

(72) Inventor: Nathan Coelho, Leo, IN (US)

(73) Assignee: Masterspas, LLC, Fort Wayne, IN (US)

( * ) Notice: Subject to any disclaimer, the term of this patent is extended or adjusted under 35 U.S.C. 154(b) by 12 days.

(21) Appl. No.: 17/203,574

(22) Filed: Mar. 16, 2021

(65) Prior Publication Data

US 2021/0198912 A1 Jul. 1, 2021

Related U.S. Application Data

(62) Division of application No. 15/970,696, filed on May 3, 2018, now Pat. No. 10,968,650.

(60) Provisional application No. 62/501,349, filed on May 4, 2017.

(51) Int. Cl.
*E04H 4/10* (2006.01)

(52) U.S. Cl.
CPC ..... *E04H 4/10* (2013.01)

(58) Field of Classification Search
CPC ..... E04H 4/08–088; E04H 4/10–108
See application file for complete search history.

(56) References Cited

U.S. PATENT DOCUMENTS 4,107,826 A 8/1978 Tysdal
4,136,408 A * 1/1979 Dahlbeck ..... E04H 15/02 52/63
4,292,913 A 10/1981 Siebert et al.
5,203,055 A * 4/1993 Broadwater, Sr. ..... B60J 7/104 160/369
5,343,824 A 9/1994 Floyd
5,800,089 A * 9/1998 Donaton ..... E04H 4/10 403/4
6,286,156 B1 9/2001 Sullivan
6,978,732 B1 12/2005 Jirak
7,389,551 B2 * 6/2008 Stebner ..... E04H 4/08 70/164
8,683,621 B1 * 4/2014 Gustason ..... E04H 4/10 4/498
9,725,919 B1 * 8/2017 Vanderpool ..... E04H 4/108
9,938,740 B1 * 4/2018 Nygard ..... A61H 33/00
10,968,650 B2 4/2021 Coelho
2005/0144714 A1 7/2005 Peng et al.
2007/0245479 A1 * 10/2007 Schroeder ..... E04H 4/08 4/498

(Continued)

OTHER PUBLICATIONS

Final Rejection dated Jul. 23, 2020 for U.S. Appl. No. 15/970,696.

(Continued)

*Primary Examiner* — David P Angwin
*Assistant Examiner* — Nicholas A Ros
(74) *Attorney, Agent, or Firm* — KAPLAN BREYER SCHWARZ, LLP

(57) ABSTRACT

A rolling cover for a spa or a pool, which can be a rolled-up into generally cylindrical configuration, and an unrolled into a generally flat configuration. The rolling cover includes a flexible top cover, a flexible sealed insulation bag, a bag support structure, a top cover support structure and a cover tightening arrangement. Further, a spa including the rolling cover.

25 Claims, 17 Drawing Sheets

(56) References Cited

U.S. PATENT DOCUMENTS

2015/0047116 A1 2/2015 Brady

OTHER PUBLICATIONS

List of references Mailed on Dec. 12, 2019 for U.S. Appl. No. 15/970,696.
List of references Mailed on Jul. 23, 2020 for U.S. Appl. No. 15/970,696.
Non-Final Office Action received for U.S. Appl. No. 15/970,696, dated Dec. 12, 2019.
Notice of Allowance and Fees Due (PTOL-85) dated Dec. 4, 2020 for U.S. Appl. No. 15/970,696.
Requirement for Restriction/Election received for U.S. Appl. No. 15/970,696, dated Jul. 10, 2019, 6 pages.

* cited by examiner

ROLLING COVER FOR A SPA

RELATED APPLICATIONS

This application is a divisional of U.S. application Ser. No. 15/970,696, filed May 3, 2018, which claims the benefit of U.S. Provisional Application No. 62/501,349, filed May 4, 2017, the entire disclosures of which are incorporated herein by reference.

FIELD

The present disclosure relates to a cover for a spa or pool. More particularly, the present disclosure relates to a rolling cover for a spa or pool, which is easy to use, has a low profile that prevents water and debris from accumulating thereon when covering the spa or pool, provides a more efficient heat insulating barrier, and includes a cover tightening arrangement that provides a tight, attractive finish when the cover is closed.

BACKGROUND

Hot tubs, also commonly referred to as spas, are increasing in popularity. Covers are typically provided with most spas for the purpose of retaining the heat in the water and preventing debris from falling into the water when the spa is not in use.

Most covers are hard, bulky, and heavy, which makes them difficult to handle when covering and uncovering the spa. In addition, although most of these covers are generally flat when new, they can sag or warp over time, which allows rainwater, dirt, leaves and the like to collect on top of them. Standing water on a spa cover presents a safety hazard to young children who can drown in a puddle of water. Sagging and warping of the cover can also create gaps between the cover and the spa, which allow heat to escape from the spa water and allow debris to enter the spa water. This, in turn, results in higher operational costs, as more energy is used to keep the spa water heated and filtered, more chemicals are used to treat the dirtier water, and filter maintenance is more frequently required.

Accordingly, an improved cover is needed which addresses the deficiencies of conventional covers.

SUMMARY

Disclosed herein is a rolling cover for use with a spa or a pool having a water holding receptacle. The rolling cover comprises a top cover comprising a flexible covering having extensions at opposing ends thereof; a flexible insulation bag coupled to the flexible covering; and a cover tightening arrangement including a lever latch assembly coupled to a free end of each of the extensions, the lever latch assembly for tightening the covering of the top cover.

One aspect of the lever latch assembly is a cover coupler for coupling the extension to the lever latch assembly. The cover coupler can include a coupling member and a retaining member, the coupling member and the retaining member clamping an end of the extension to the lever latch assembly. The cover coupler can further include a gripping clip to facilitate manually grasping and operating the lever latch assembly.

Another aspect of the lever latch assembly is a pivot latch for detachably coupling the lever latch assembly to the spa or the pool. The pivot latch can include a flared lip.

Another aspect of the lever latch assembly is a lever arm. The lever arm can include first and second sections which are movable relative to one another for adjusting a length of the lever latch assembly. One of the first and second sections can include a tongue portion and the other one of the first and second sections can include a clamping arrangement for clamping the tongue once the length of the lever latch assembly has been selected, to prevent relative movement between the first and second sections.

In some embodiments, the cover tightening arrangement further includes a latch keeper for coupling to the spa or the pool, the lever latch assembly operatively engaging the latch keeper to tighten the covering of the top cover.

One aspect of the insulation bag is a flexible radiant barrier layer and a flexible insulation layer contained in the bag. In some embodiments, the flexible radiant barrier layer is disposed under the flexible insulation layer, adjacent a bottom wall of the insulation bag.

In some embodiments, the rolling cover can further comprise a plurality of bag support ribs, which hold the insulation bag above an operating water level of the shell of the spa or the pool when the rolling cover is unrolled. The bag support ribs can comprise pultrusions or extrusions. The bag support ribs can be coupled to the insulation bag with a plurality of fasteners. The fasteners can couple the bag support ribs to a top wall of the insulation bag.

In some embodiments, the insulation bag can include a plurality of strips of flexible material coupled to and extending across an interior surface of the insulation bag, wherein the strips of flexible material retain a first end of each of the fasteners. The interior surface of the insulation bag can be defined by a bottom wall of the insulation bag, wherein the first end of each of the fasteners is disposed between the interior surface of the bottom wall of the insulation bag and an associated one of the strips of flexible material.

In some embodiments, the rolling cover can further comprise a plurality of top cover support ribs that hold the top cover in a configuration that causes external debris to runoff the top cover when the rolling cover is unrolled. The top cover support ribs can comprise pultrusions or extrusions. The top cover support ribs can be disposed on the bag support ribs. The top cover support ribs can be shorter than the bag support ribs.

In some embodiments, the rolling cover can further comprise a plurality of rib straps, wherein each of the rib straps extends from one of the top cover support ribs to an end of the bag support rib on which that top cover support rib is disposed. The rib straps assist the top cover support ribs with holding the top cover in the configuration that causes external debris to runoff the top cover when the rolling cover is unrolled.

In some embodiments, the rolling cover can further comprise a rib strap extending from a first one of the bag support ribs disposed at a first end of the insulation bag to a second one of the bag support ribs disposed at a second end wall of the insulation bag, wherein the rib strap is coupled to the top cover support ribs.

In some embodiments, the rolling cover can further comprise a cover strap extending from each end of at least one of the bag support ribs, wherein the cover straps secure the rolling cover to the spa or the pool.

In some embodiments, the rolling cover can further comprise a skirt coupled to the top cover, wherein the skirt covers the latch lever assemblies and ends of the bag support ribs.

In some embodiments, the rolling cover can further comprise lever latch locks for coupling to the spa or the pool.

Each of the lever latch locks is movable between a first position and a second position, wherein the lever lock in the first position allows a corresponding one of the lever latch assemblies to be freely pivoted to couple or uncouple the lever latch assembly to and from the spa or the pool, and wherein each of the lever latch locks in the second position prevents the corresponding lever latch assembly from freely pivoting once the lever latch assembly has been coupled to the spa, the hot, or the pool.

Further disclosed herein is a spa comprising a water holding shell and the rolling cover described above for covering the shell when the spa is not in use.

BRIEF DESCRIPTION OF THE DRAWING

FIG. 8A illustrates the lever latch lock rotated into an unlocked position. FIG. 8B illustrates the lever latch lock rotated into a locked position.

DETAILED DESCRIPTION

Figure 1:
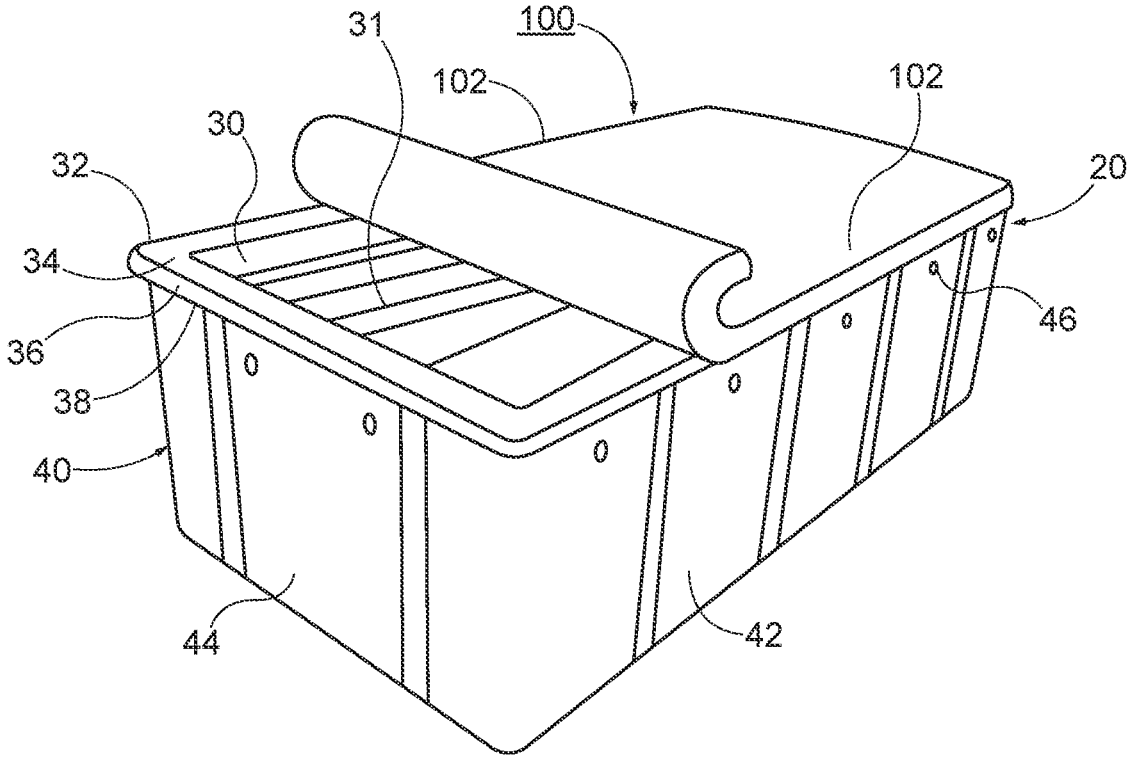
FIG. 1 is a top perspective view of an embodiment of a rolling cover according to the present disclosure partially rolled-up on a spa.

The disclosure is best understood from the following detailed description when read in conjunction with the figures of the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and the drawing. In the description, the term "coupled" means that the elements can be directly connected together or can be connected through one or more intervening elements.

FIG. 1 illustrates an embodiment of a rolling cover 100 according to the present disclosure. The rolling cover 100 is intended to be used for covering spa 20, as illustrated in FIG. 1. The term "spa," as used herein, includes any large jetted tub filled with water that is heated and/or unheated and constructed for recreation, physical therapy, exercise and/or swimming. The cover 100 can also be used for covering above-ground pools and other water holding recreational or therapeutic structures. The spa 20 typically includes a spa shell 30, a frame for supporting the shell 30 (not visible) and a spa cabinet 40 enclosing the frame and other components of the spa 20, such as a spa pump and a spa heater. The spa shell 30 includes a rim 32 formed by a horizontally extending shoulder 34 and a downwardly extending sidewall 36, which defines a bottom facing edge surface 38. The spa cabinet 40 includes opposing side panels 42 and opposing end panels 44. Each of the side panels 42 can include a plurality of spaced-apart strap fastener catches 46.

Referring still to FIG. 1, the rolling cover 100 is constructed and adapted to be rolled-up into a generally cylindrical roll-like configuration when the spa is to be used, and an unrolled into a generally flat configuration when the spa is not used. The rolling cover 100 can be rolled-up to either end of the spa 20 and stored on the rim 32 of the spa shell 30, or rolled-up beyond the spa shell 30 onto a shelf disposed at either end of the spa 20, thereby leaving the spa 20 uncovered for use. When the spa 20 is not in use, the rolling cover 100 can be unrolled over the spa shell 30 of the spa 20 (into the generally flat configuration) to cover the opening 31 thereof.

Figure 2:
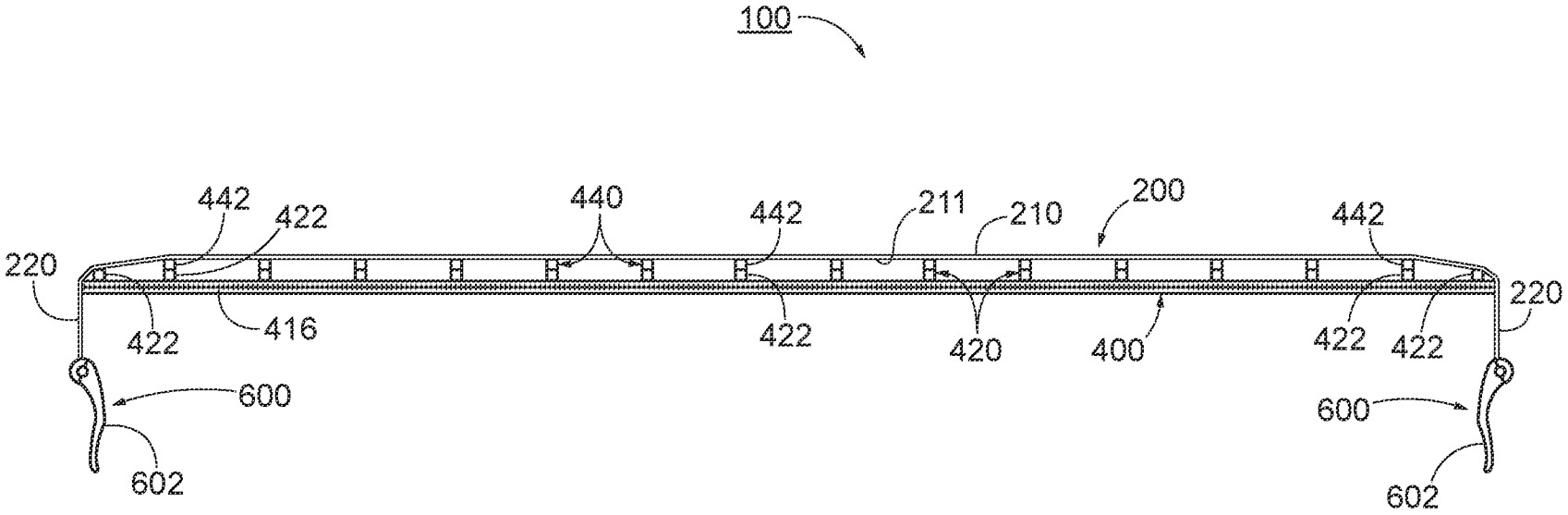
FIG. 2 is a side view of the rolling cover of FIG. 1 with a side skirt of a top cover of the rolling cover removed to allow embodiments of a flexible sealed insulation bag, a bag support structure, and a top cover support structure of the rolling cover to be viewed.

The rolling cover 100 comprises a flexible top cover 200, as illustrated in the side view of FIG. 2 in the unrolled configuration with a side skirt of the top cover 200 removed. The rolling cover 100 further comprises flexible sealed insulation bag 400, a bag support structure 420, a top cover support structure 440 and a cover tightening arrangement 600. The top cover 200 prevents rainwater, leaves, snow and other debris from entering the spa 20 and presents a flattened domed configuration, which allows rainwater, leaves, snow and other debris to runoff the sides and ends of the rolling cover 100. The insulation bag 400 is disposed under the top cover 200 and retains the heat in the spa water. The bag support structure 420 holds the insulation bag 400 above the normal or standard operating water level of the spa shell 30 of the spa 20 when the rolling cover 100 is unrolled and side margins 102 of the cover 100 are lying on the rim 32 of the spa shell 30 (FIG. 1). The top cover support 440 structure holds the top cover 200 in the flattened domed configuration when the rolling cover 100 is unrolled.

Top Cover

Referring still to FIG. 2, the flexible top cover 200 includes a flexible covering 210, which is sized to generally overlie and cover the insulation bag 400, the bag support structure 420 and the top cover support structure 440. The covering 210 includes end portions or extensions 220 that extend down past the insulation bag 400 when the rolling cover 100 is unrolled over the spa 20. The top cover 200 is coupled to the bag support structure 420 as will be described further on.

As collectively illustrated in FIGS. 3A-3D, the top cover 200 further includes an arrangement of flexible skirts 300, which are coupled to the covering 210 by sewing, hook and loop connectors, or any other suitable method for coupling the flexible skirts to the covering 210. As illustrated, the skirt arrangement 300 includes side skirts 310, end skirts 320, and corner skirts 330. The upper edges 312 of the side skirts 310 can be coupled to side edge margins 214 of the covering 210. The upper edges 322 of the end skirts 320 can be coupled to the covering 210 along line 212. Each of the corner skirts 330 has a first upper edge portion 332 coupled to the covering 210 along line 212 and a second upper edge portion 334 coupled to an adjacent one of the side skirts 310 along line 336. As illustrated in FIG. 2, the side skirts 310 cover the exposed ends of the bag support structure 420 and the exposed ends of the top cover support structure 440. The end skirts 320 cover tightening arrangement 600. Alternate embodiments of the skirt arrangement are contemplated. For example, the skirt arrangement can comprise a single continuous skirt or more or less than the eight (8) skirts illustrated in the embodiment of FIGS. 3A-3D.

The covering 210 of the top cover 200 and skirts 310, 320, 330 of the skirt arrangement 300 should be made of a synthetic or non-synthetic weatherproof material that does not significantly stretch when pulled tight. For example, but not limitation, the top cover 200 can be made of a vinyl material. The skirts 310, 320, 330 of the skirt arrangement 300, should be made of a synthetic or non-synthetic weatherproof material, such as vinyl.

Insulation Bag

Figure 4A:
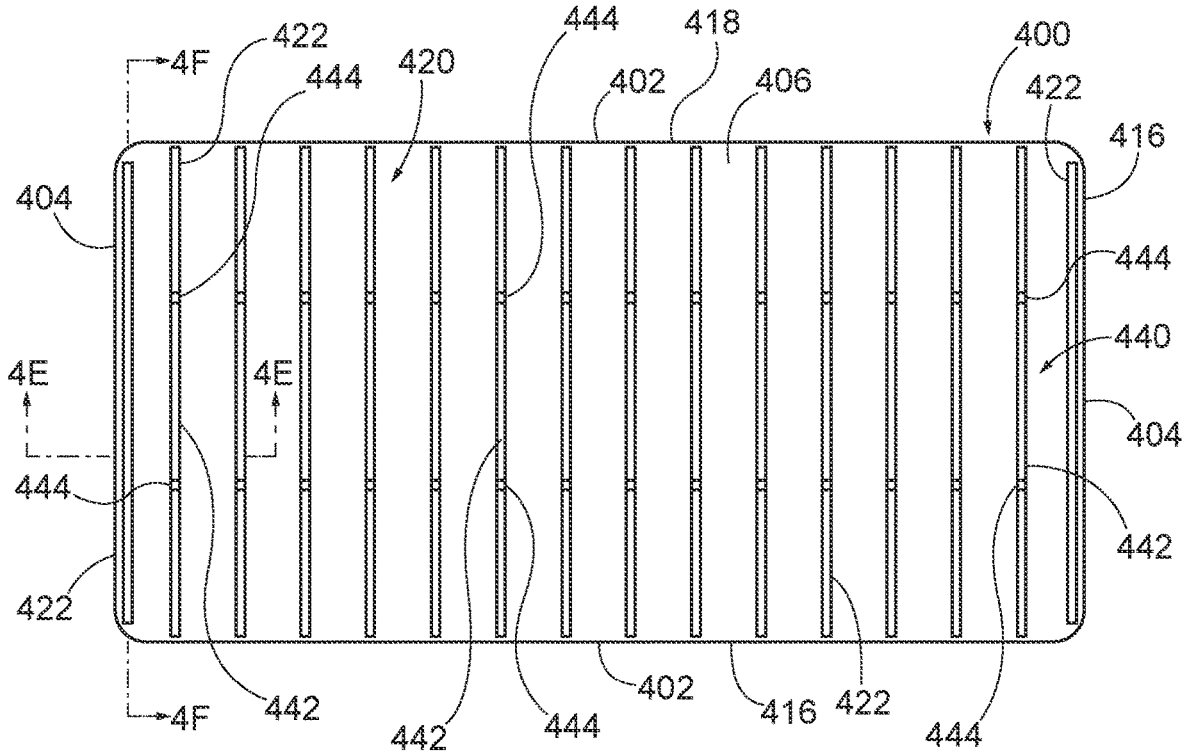
FIG. 4A is a top view of the insulation bag, the bag support structure, and the top cover support structure of the rolling cover.
Figure 4B:
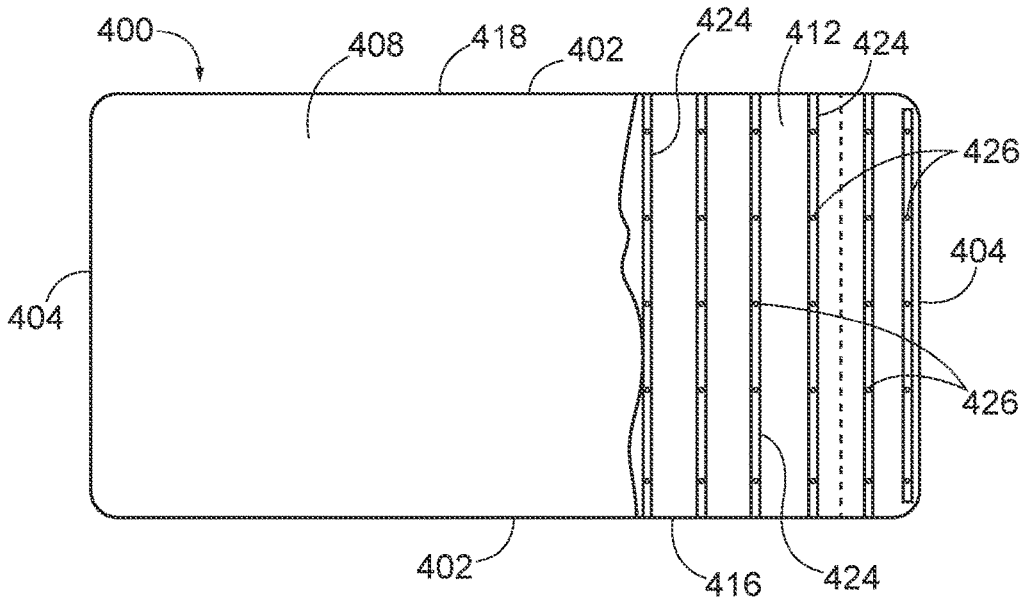
FIG. 4B is a bottom view of the insulation bag of the rolling cover with a bottom wall of the bag cutaway to allow viewing of flexible strips that retain fasteners, which secure bag support ribs of the bag support structure to the insulation bag.
Figure 4D:
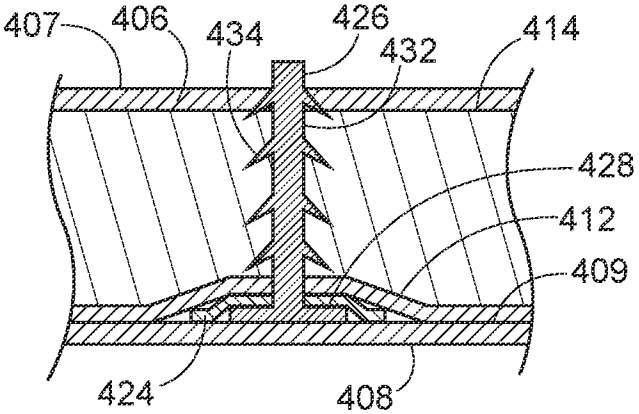
FIG. 4D is a sectional side view through a segment of the insulation bag of the rolling cover illustrating one of the fastener retaining strips illustrated in FIG. 4B.
Figure 4C:
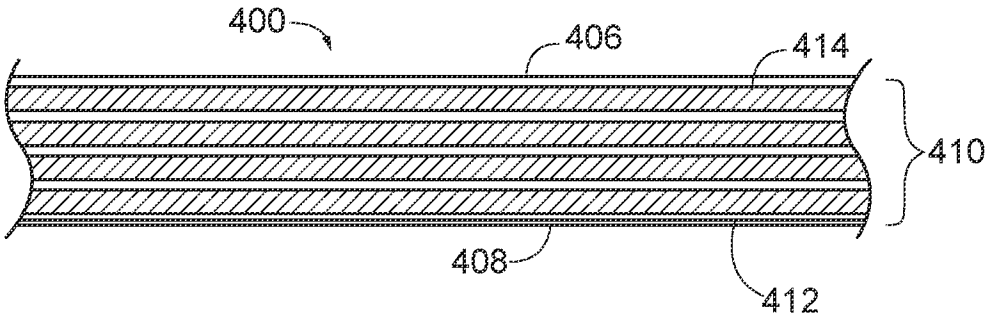
FIG. 4C is sectional view through a segment of the insulation bag of the rolling cover illustrating an embodiment of an insulation structure.

As collectively illustrated in FIGS. 4A-4C, the sealed insulation bag 400 includes sidewalls 402, end walls 404, a top wall 406 (FIG. 4A), a bottom wall 408 (FIG. 4B), and an insulation structure 410 (FIG. 4C). The insulation bag 400 further includes a zipper 416, which can extend along the end walls 404 and one of the sidewalls 402 (see FIG. 2). The zipper 416 allows the insulation bag 400 to be opened to insert the insulation structure 410 into the bag 400 and then closed again during the manufacture of the bag 400. The other one of the sidewalls 402 is operative as a hinge 418 so that the top wall 406 or bottom wall 408 can be pivoted open and closed with respect to the other one of the top wall 406 and bottom wall 408 when the zipper 416 is unzipped.

As illustrated in FIG. 4C, the insulation bag 400 contains the insulation structure 410, which comprises a flexible radiant barrier layer 412 and a flexible insulation layer 414. In a preferred embodiment, the insulation structure 410 is positioned in the bag 400 such that the flexible radiant barrier layer 412 is disposed between the flexible insulation layer 414 and the bottom wall 408 of the insulation bag 400, so that the radiant barrier layer 412 is the first portion of the insulation structure 410 to be exposed to heat radiated by the spa water after the heat radiates through the bottom wall 408 of the insulation bag 400. Thus, in the preferred embodiment, the flexible radiant barrier layer 412 will reflect the radiant heat back into the spa water without having to be transmitted through the flexible insulation layer 414, as would be the case in embodiments where the radiant barrier 412 is disposed between the insulation layer 414 and the top wall 406 of the insulation bag 400.

The insulation bag 400 should be made of a synthetic or non-synthetic weatherproof material, such as a vinyl reinforced fabric or a rubber membrane. The flexible radiant barrier layer 412 of the laminated insulation structure 410 can comprise a radiant barrier foil material or any other suitable flexible radiant barrier material. The flexible insulation layer 414 of the laminated insulation structure 410 can comprise one or more layers of polyethylene closed-cell foam or any other suitable flexible insulation material.

Bag Support Structure

As collectively illustrated in FIGS. 2 and 4A, the bag support structure 420 in one embodiment comprises a first plurality of spaced apart ribs 422 (bag support ribs 422) secured to the top wall 406 of the sealed insulation bag 400. The bag support ribs 422 extend laterally across the top wall 406 of the insulation bag 400 between the side walls 402. The bag support ribs 422 can comprise hollow, square or rectangular fiberglass pultrusions or structural extrusions.

Figure 4E:
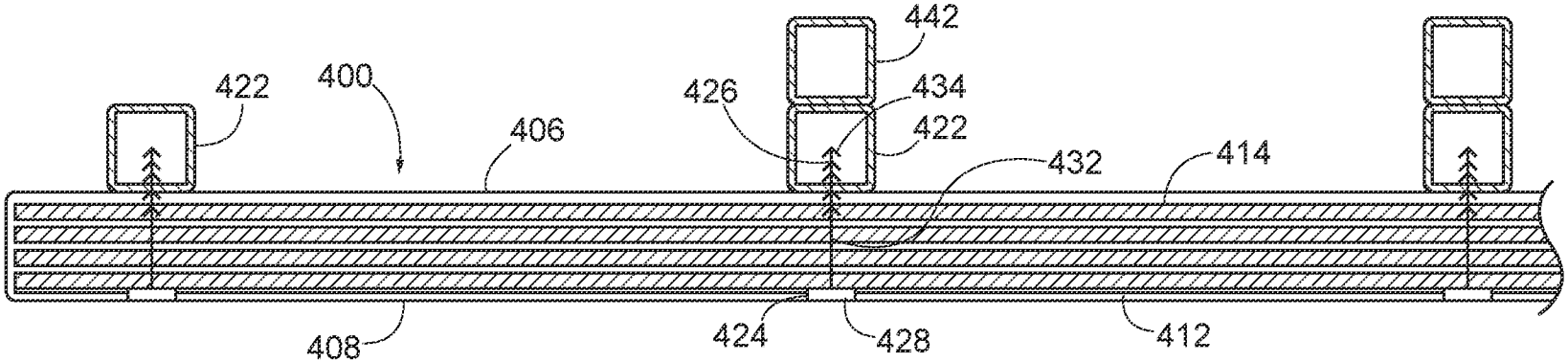
FIG. 4E is a sectional view through line 4E-4E in FIG. 4A.
Figure 4F:
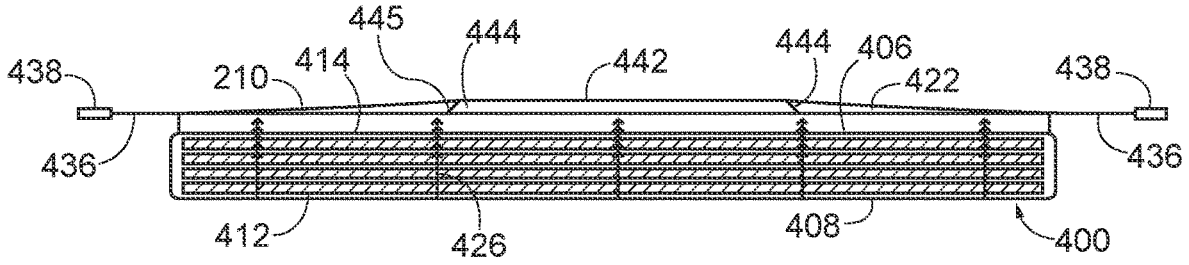
FIG. 4F is a sectional view through line 4F-4F in FIG. 4A.

As illustrated in FIG. 4B, a plurality of spaced apart strips of flexible material 424 extend laterally across the interior surface 409 of the bottom wall 408 of the insulation bag 400 between the side walls 402 thereof, so that they are parallel with the bag support ribs 422 (FIG. 4E). As illustrated in FIG. 4D, the lateral edges of each strip 424 are attached to the interior surface 409 of the bottom wall 408 of the insulation bag 400. The strips 424 retain a plurality of fasteners 426, which secure each bag support rib 422 to (the top wall 406 of) the bag 400. The fasteners 426 can each include an enlarged head 428 and a leg 432 depending from a central portion of the head 428. As illustrated in FIGS. 4D-4F, the enlarged head is captured between the strip 424 and the bottom wall 408 of the bag 400. The legs 432 of the fasteners 426 extend through openings (not shown) provided in the strips 424, the flexible radiant barrier layer 412, the insulation layer 414, the bag top wall 406 and partially into apertures (not shown) in the bag support ribs 422. The leg 432 includes a plurality of upwardly angled retention barbs or flutes 434, which are configured to distort or collapse in a direction towards leg 432 during insertion of the fastener 426 into a corresponding aperture in the rib 422. The inward collapse of flutes 434 decreases the amount of force required to insert the fastener 426 into the aperture, and due to its resilient construction, the flutes 434 return to their original position after insertion to prevent the release of the fastener 426 from the rib 422. The fasteners 426 can comprise well known plastic Christmas Tree fasteners or any other suitable fastener.

As illustrated in FIG. 4F, a cover strap extends 436 from the opposing ends of selected ones of the bag support ribs 422 with a screw fastener, rivet fastener, or any other suitable fastener 447, to couple the cover support rib 442 to the bag support rib 422. The opposite free end of each cover strap 436 includes a catch member 438 that releasably couples to a corresponding one of the catch members 45 coupled to the outer surface of a corresponding one of the side panels 42 of the spa cabinet 40. Further, the side edges of the covering 210 of the top cover 200 are coupled to the ends of the bag support ribs 422 with screw fasteners, rivet fasteners, or any other suitable fastener 447. The covering 210 of the top cover 200 may also be coupled to the bag support ribs 422 adjacent the immediately adjacent the end walls 404 of the insulation bag 400 with screw fasteners, rivet fasteners, or any other suitable fastener (not shown).

Top Cover Support Structure

As collectively illustrated in FIG. 2 and FIGS. 4A, 4E, and 4F, the top cover support structure 440 comprises a second plurality ribs 442 (cover support ribs 442). The cover support ribs 442 can comprise hollow, square or rectangular fiberglass pultrusions or structural extrusions. In the embodiment illustrated in the drawing, each cover support rib 442 is coupled to one of the bag support ribs 422 except for the bag support ribs 422 immediately adjacent the end walls 404 of the insulation bag 400 to allow rainwater, leaves, snow and other debris to runoff the ends of rolling cover 100. In other embodiments, cover support ribs 442 can also be coupled to the end bag support ribs 422. The cover support ribs 442 are shorter than the bag support ribs 422 and are centrally located on top of the bag support ribs 422, as illustrated in FIG. 4E. The end of each cover support rib 442 is angled to form a beveled edge 444, which allows insertion of a screw fastener, rivet fastener, or any other suitable fastener 445, to couple the cover support rib 442 to the bag support rib 422 (FIG. 4F).

Figure 3A:
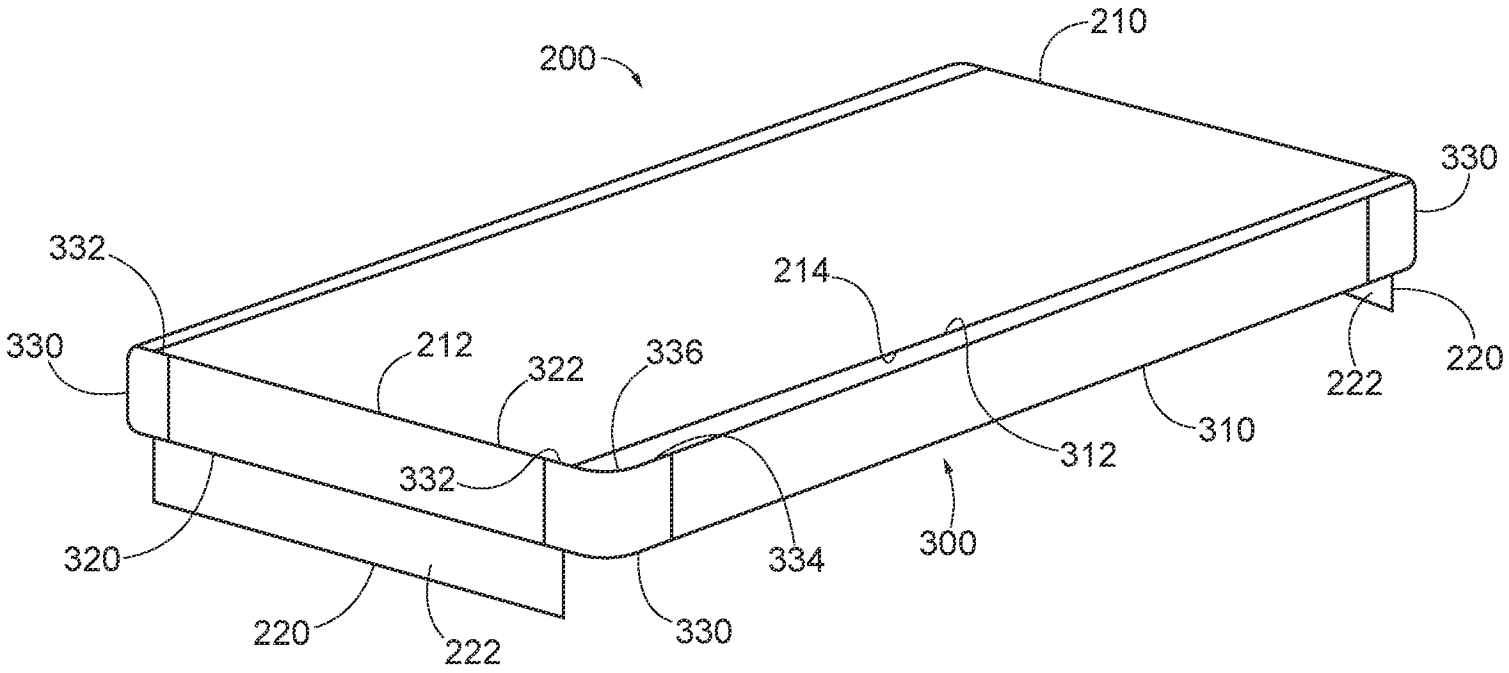
FIG. 3A is a top perspective view of an embodiment of the top cover of the rolling cover.
Figure 3B:
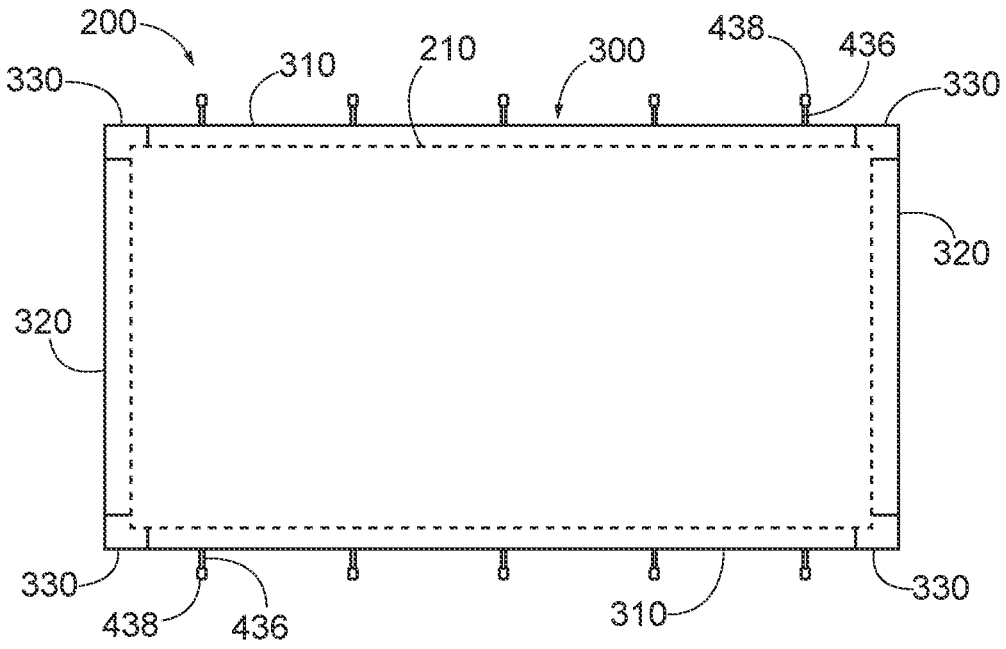
FIG. 3B is a top view of the top cover illustrated in FIG. 3A.
Figure 3C:
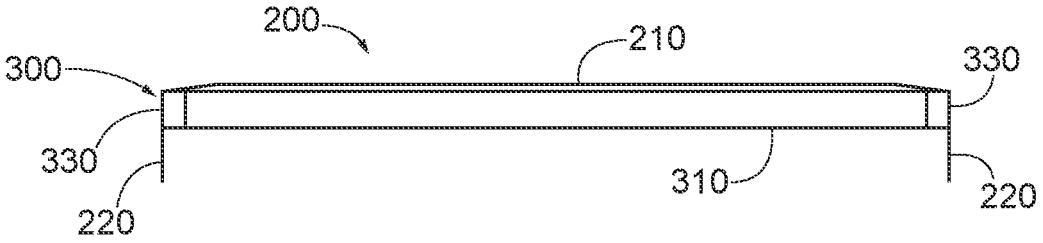
FIG. 3C is a side view of the top cover illustrated in FIG. 3A.
Figure 3D:
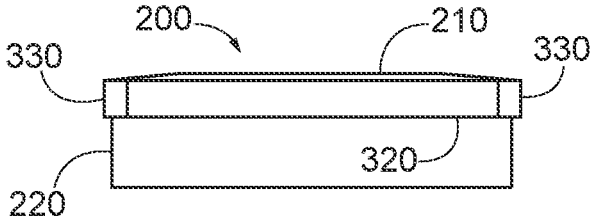
FIG. 3D is an end view of the top cover illustrated in FIG. 3A.
Figure 5:
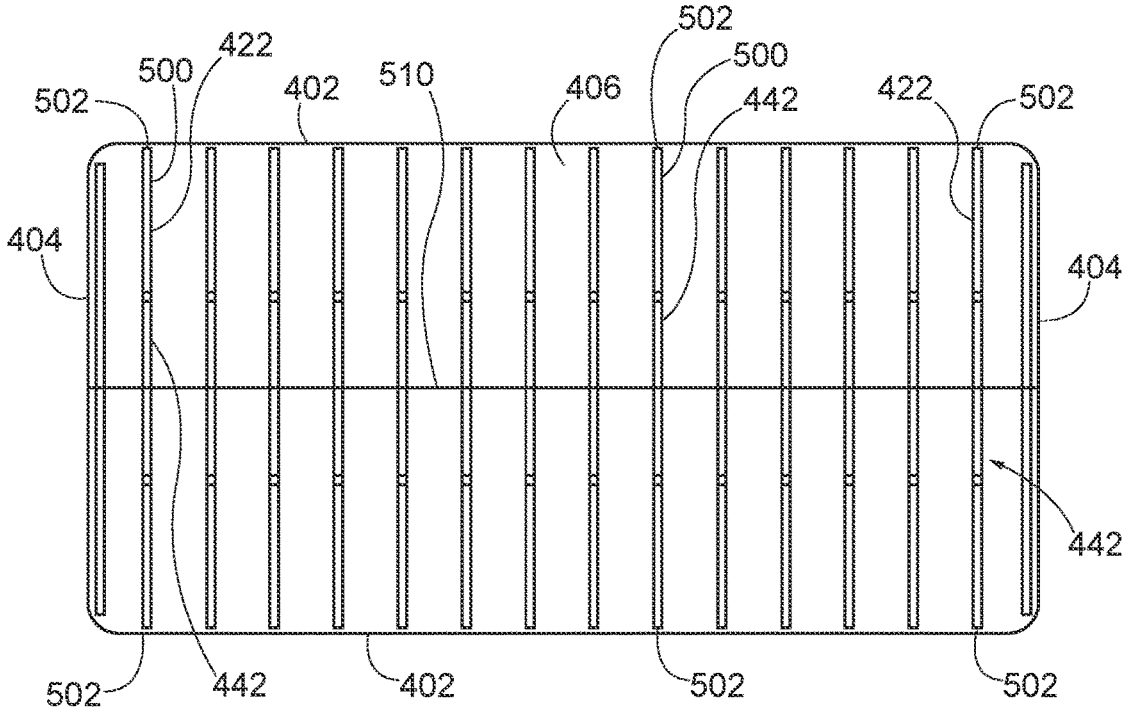
FIG. 5 is a top view of the insulation bag, the bag support structure, and the top cover support structure of the rolling cover, which illustrate embodiments of lateral rib straps and a longitudinal rib strap of the rolling cover.

Referring to FIG. 5, a plurality of lateral rib straps 500 extend over each coupled pair of cover and bag support ribs 442, 422. The rib straps 500 aid in holding the top cover 200 in a flattened domed configuration, as illustrated in FIG. 3D. As illustrated in FIG. 5, each lateral rib strap 500 extends from one end of its corresponding bag support rib 422 to the other opposite end of the corresponding bag support rib 422, and the ends 502 of the rib strap 500 are coupled to the opposing ends of the corresponding bag support rib 422 (typically at the top of the bag support rib 422) using screw fasteners, rivet fasteners, or any other suitable fasteners. A longitudinal rib strap 510 extends from the bag support rib 422 immediately adjacent the end wall 404 of the insulation bag 400 to the bag support rib 422 immediately adjacent the second end wall 404 of the insulation bag 400. One end of the longitudinal rib strap 510 is coupled to the bag support rib 422 immediately adjacent one of the end walls 404 of the insulation bag 400 typically midway between the ends of that bag support rib 422, and the other end of the longitudinal rib strap 510 is coupled to the bag support rib 422 immediately adjacent the other one of the end walls 404 of the insulation bag 400 typically midway between the opposing ends of that bag support rib 422. The longitudinal rib strap 510 is also coupled to each cover support ribs 442 typically midway between the ends thereof. The purpose of the longitudinal rib strap 510 is to aid in pulling the cover and bag support ribs 442, 422, back up into the vertical position shown in FIGS. 2 and 4E, when the rolling cover 100 is unrolled over the spa, as the cover and bag support ribs 442, 422 tend to lie down horizontally onto the top wall 406 of the insulation bag 400 when the rolling cover 100 is rolled-up. The longitudinal rib strap 510 can be coupled to the ribs 422, 444 using screw fasteners, rivet fasteners, or any other suitable fasteners.

Cover Tightening Arrangement

Figure 6A:
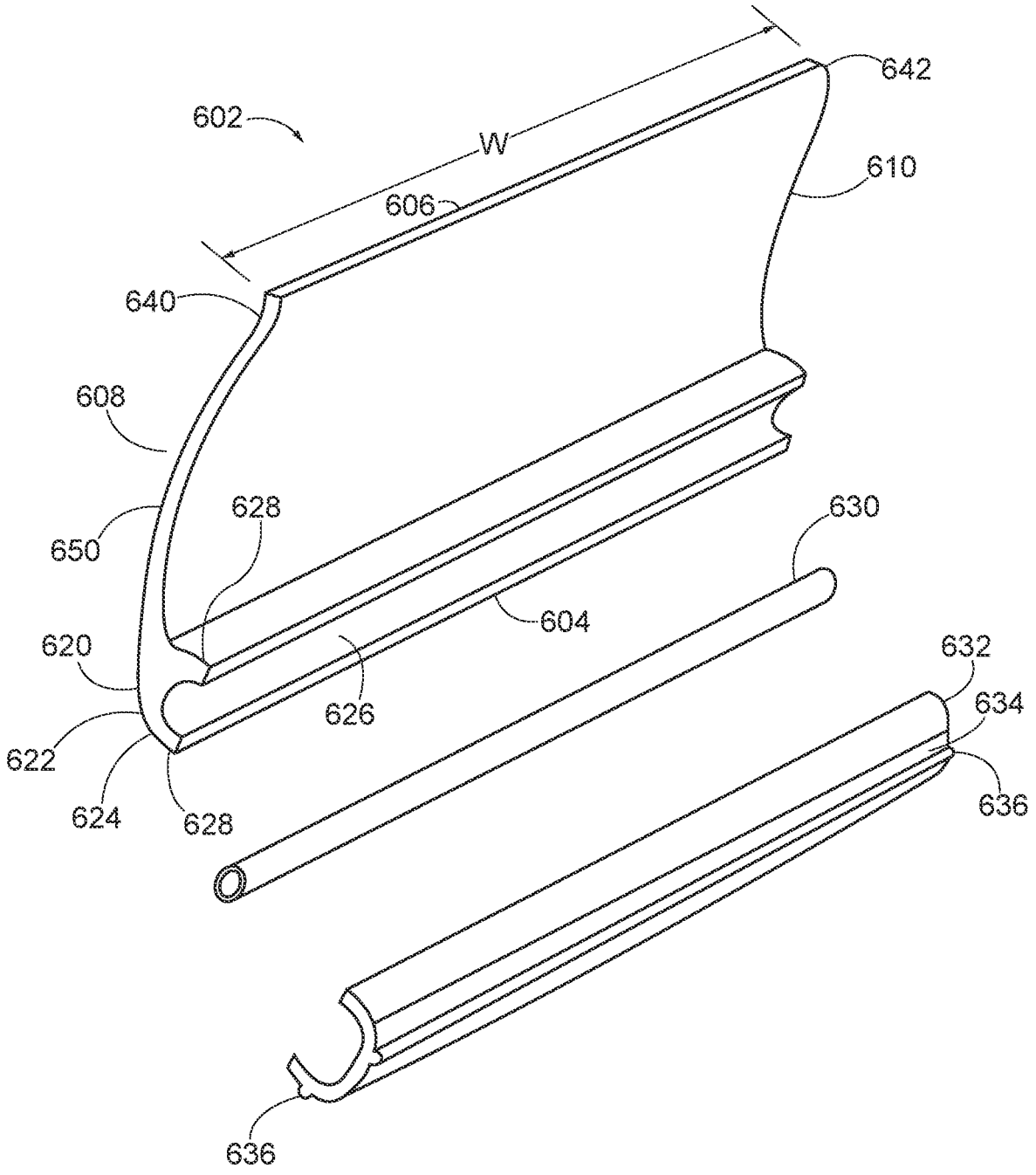
FIGS. 6A and 6B are exploded and assembled perspective views, respectively, of an embodiment of a lever latch assembly of a cover tightening arrangement of the rolling cover.
Figure 6B:
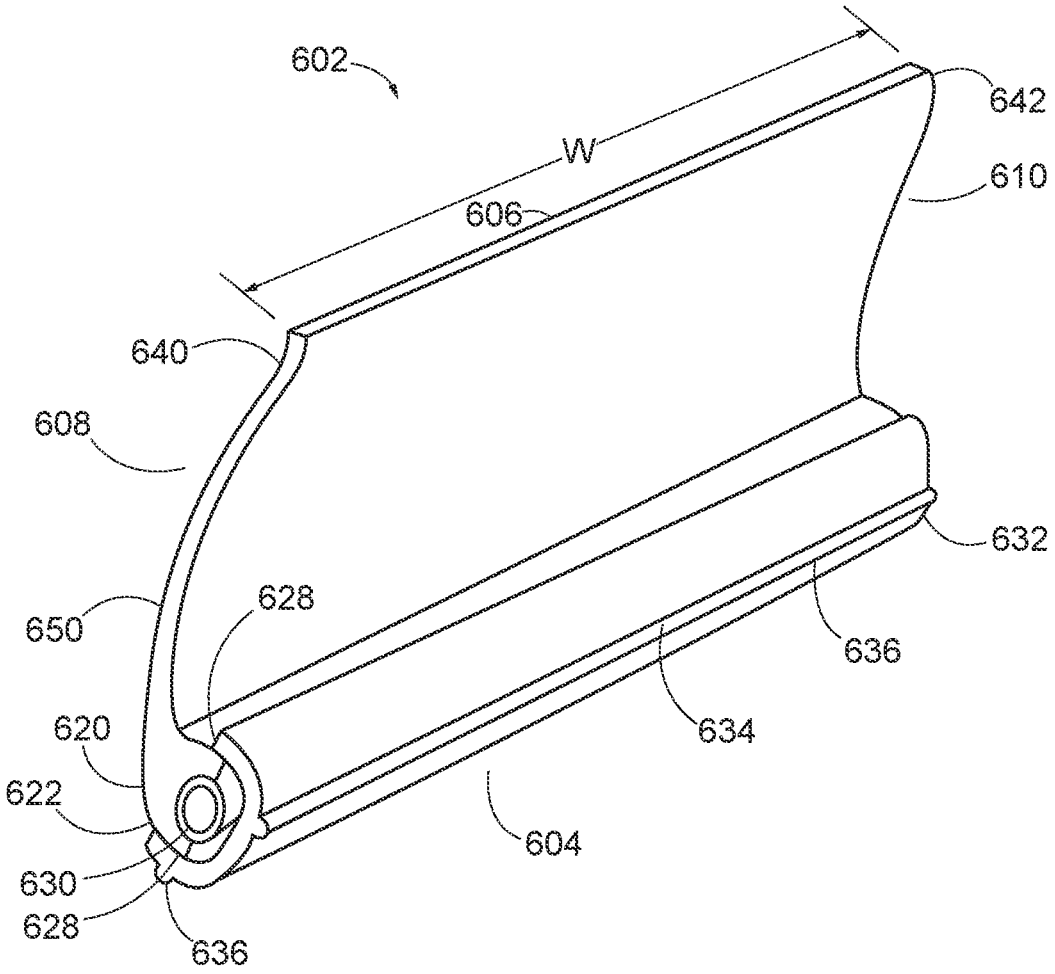

Referring again to FIG. 2, the cover tightening arrangement 600 includes first and second lever latch assemblies 602, each of which is coupled to the free end 222 of one of the extensions 220 of the covering 210. As collectively illustrated in FIGS. 6A-6C, the lever latch assembly 602 has a first end 604, a second end 606, a first side 608, a second side 610, a cover coupler 620 at the first end thereof 604, a pivot latch 640 at the second end thereof 606, and a lever arm 650 extending between the cover coupler 620 and the pivot latch 640. The cover coupler 620 of the lever latch assembly 602 defines a coupling member 622. The pivot latch 640, lever arm 650, and the coupling member 622 of the cover coupler 620 typically form a single unitary member made from a suitably rigid material, such as plastic or metal material. The lever latch assembly 602 has a width W that generally corresponds to the width of the corresponding extension 220 of the covering 210.

Figure 6C:
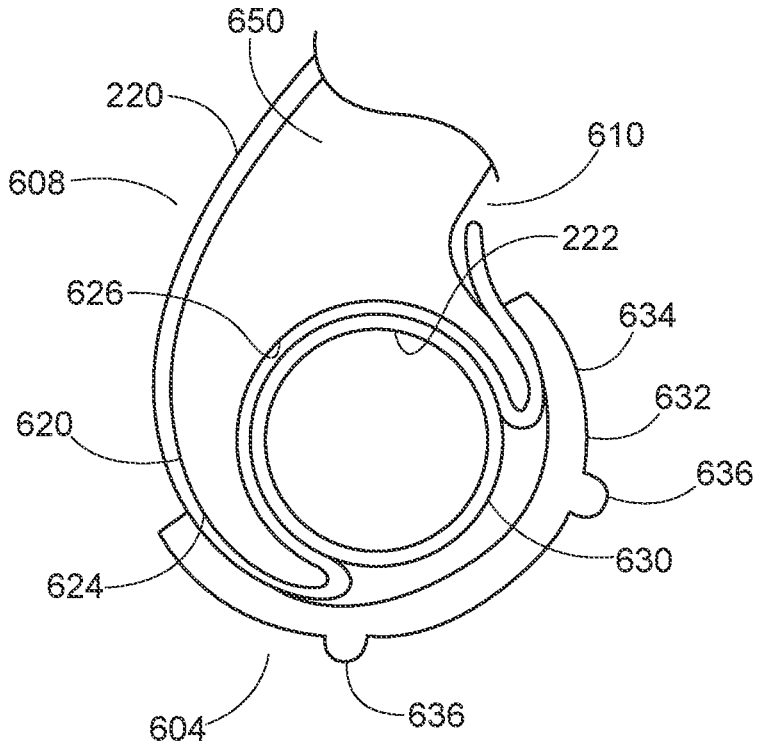
FIG. 6C is an enlarged side view of a first end of the lever latch assembly of FIGS. 6A and 6B.

The cover coupler 620 of the lever latch assembly 602 includes a rigid retaining member 630 and a gripping clip 632. The coupling member 622 extends from the lever arm 650 toward the first end 604 of the lever latch assembly 602 and turns toward the second side 610 of the lever latch assembly 602, thereby defining a bullnose surface 624. The coupling member 622 has a cavity 626 that opens toward the second side 610 of the lever latch assembly 602, which is sized and shaped to receive and hold the retaining member 630 therein in a snap-fit manner. As best illustrated in FIG. 6C, the purpose of the retaining member 630 is to clamp the free end 222 of the extension 220 of the covering 210 against the surface of the cavity 626, to couple the extension 220 to the latch lever assembly 602. The retaining member 630 also provides the lever latch assembly 602 with rigidity. The retaining member 630 can comprise a steel pipe or any other suitable member capable of clamping the free end 222 of the covering extension 220 against the surface of the coupling member cavity 626 and providing the lever latch assembly 602 with rigidity. The gripping clip 632 is constructed to clip onto fingers 628 of the coupling member 622 and thereby provide a surface for the user to easily grasp when operating the lever latch assembly 602. The gripping clip 632 can have one or more ribs 636 on the outer surface 634 thereof that further aid in gripping the lever latch assembly 602, and can be made from a plastic or metal material. One or more screw fasteners (not shown) may be used to secure the gripping clip 632 to the fingers of the coupling member.

Figure 6D:
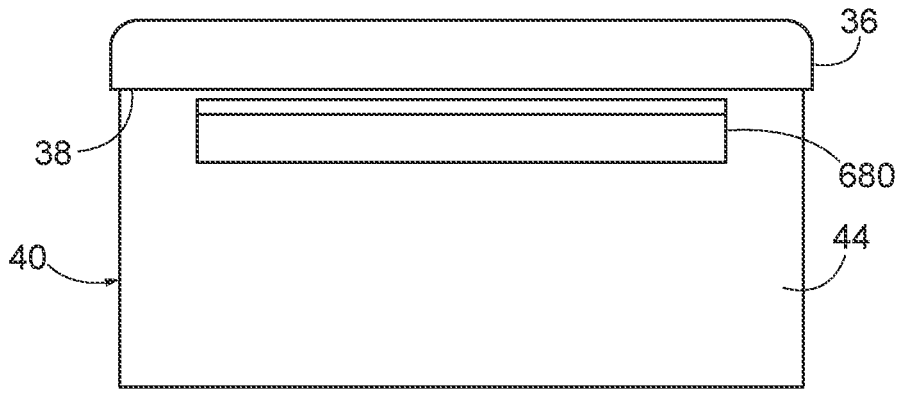
FIG. 6D is an end view of a spa, which illustrates an embodiment of an optional latch keeper of the cover tightening arrangement, coupled to an end panel of a spa cabinet of the spa.
Figure 6E:
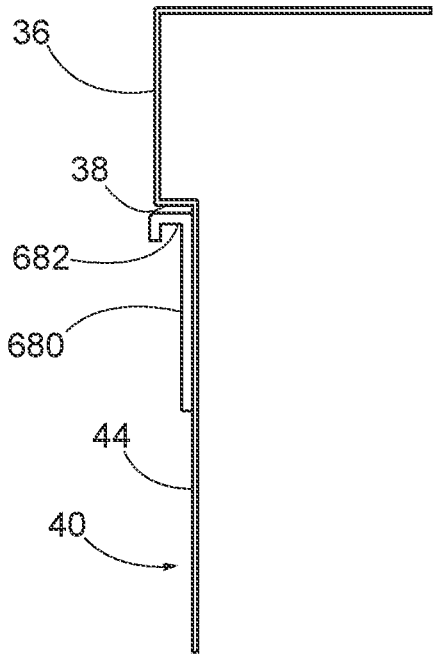
FIG. 6E is a side view of the latch keeper of FIG. 6D.

The pivot latch 640 of the lever latch assembly 602 includes a lip 642 that extends from the lever arm 650 toward the second end 606 of the lever latch assembly 602. The lip 642 flares towards the first side 608 of the lever latch assembly 602. The lip 642 of the pivot latch 640 is sized to be pivotally received in a channel 682 of an elongated latch keeper 680 coupled to each end panel 44 of the spa cabinet 40, as illustrated in FIGS. 6D and 6E. The channel 682 has a J-shape, but may be L-shaped, U-shaped or any other suitable shape that is capable of pivotally receiving the flared lip 642 of the pivot latch 640. The channel 682 may also be coupled to the frame or spa shell 30 of the spa 20 or any combination of the end panel 44, frame, and spa shell 30.

In other embodiments, the latch keepers 680 can be omitted. In such embodiments, the flared lip 642 of the pivot latch 640 of the lever latch assembly 602 can pivotally engage the bottom edge 38 of the sidewall 36 of rim 32 of the shell 30 (see bottom edge 38 in FIG. 6E).

Figure 7A:
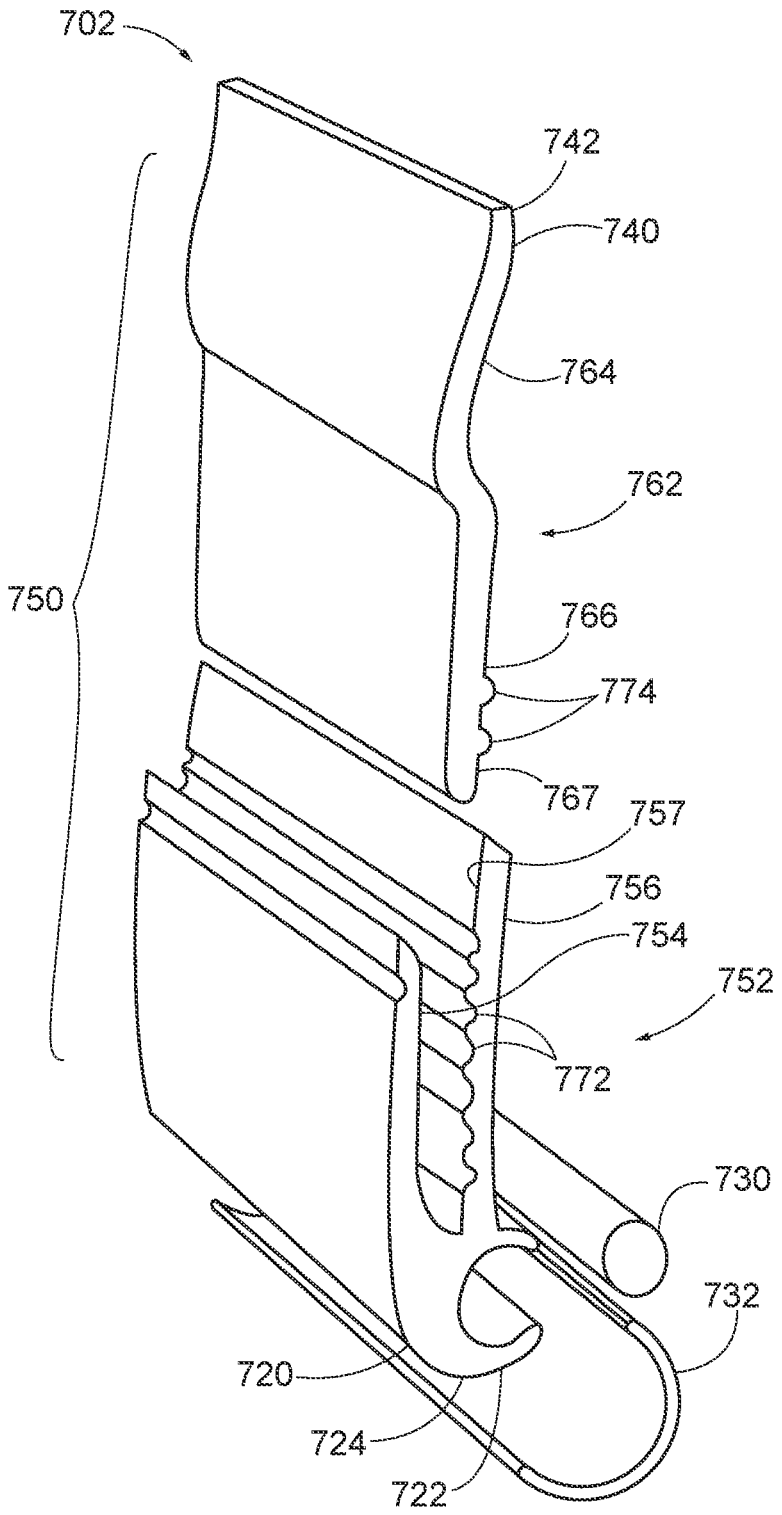
FIGS. 7A and 7B are exploded and assembled perspective views, respectively, of another embodiment of a lever latch assembly of a cover tightening arrangement of the rolling cover.
Figure 7B:
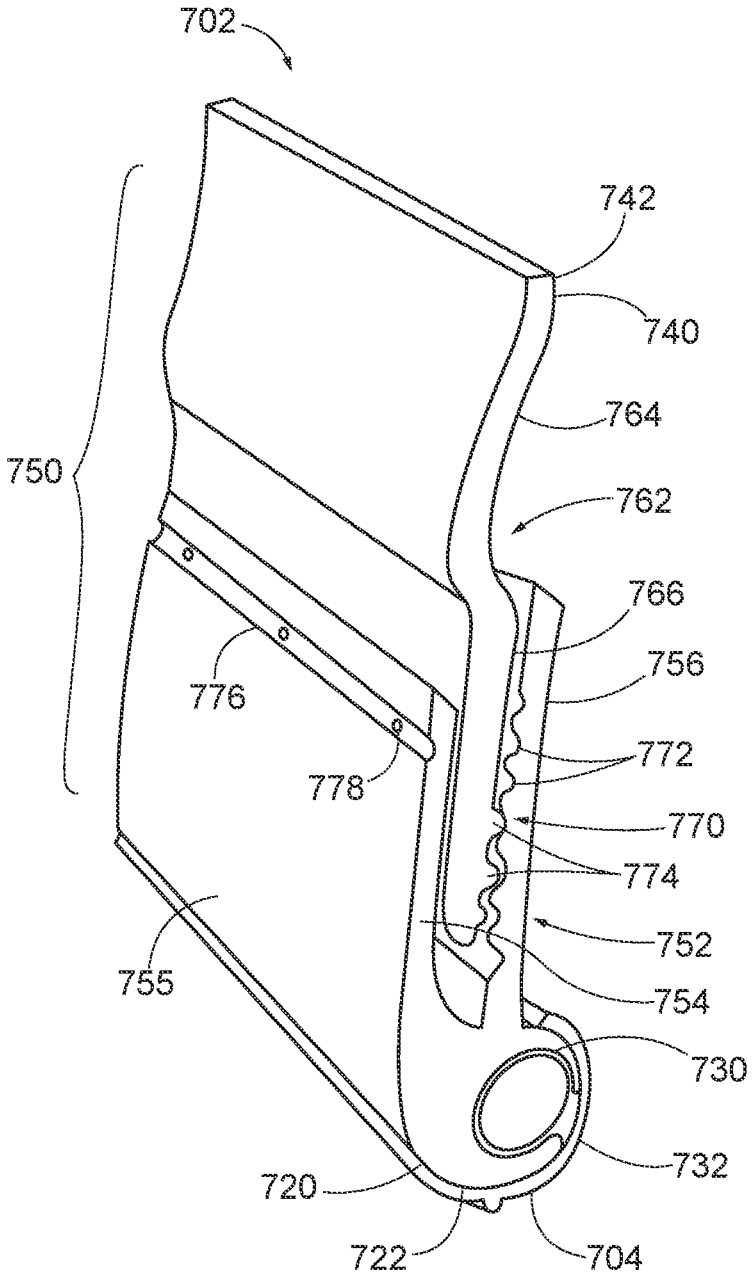

FIGS. 7A and 7B collectively illustrate another embodiment of the lever latch assembly 702. The lever latch assembly 702 is similar to the lever latch assembly 602 of FIGS. 6A-6C and, therefore, includes a cover coupler 720 having a coupling member 722, a rigid retaining member 730 and a gripping clip 732, a pivot latch 740 having a lip 742, and a lever arm 750 extending between the cover coupler and the pivot latch 740. The lever latch assembly 702, however differs from the latch lever assembly 602 of FIGS. 6A-6C in that the lever arm 750 includes separate first and second sections 752, 762, which allow the length of the lever latch assembly 702 to be selectively varied (increased or decreased in length), to operatively increase or decrease the tension on the covering 210 of the top cover 200. Increasing the length of the lever latch assembly 702 increases the tension on the covering 210 by pulling the extension 220 of the covering 210 a longer distance down the side of the spa cabinet 40 and decreasing the length of the lever latch assembly 702 decreases the tension on the covering 210 by pulling the extension 220 of the covering 210 a shorter distance down the side of the spa cabinet 40.

Still referring to FIGS. 7A and 7B, the first section 752 of the lever arm 750 has outer and inner jaws 754, 756 that extend from the coupling member 722. The second section 762 of the lever arm 750 has a bent structure including an unclamped portion 764 extending from pivot latch 740 and a tongue portion 766 extending from the unclamped portion 764. The tongue portion 766 of the second section 762 of the lever arm 750 is received in the space 755 between the outer and inner jaws 754, 756 of the first section 752 of the lever arm 750. The length of the lever latch assembly 702 can be selectively increased or decreased by increasing or decreasing how far the tongue portion 766 is inserted into the space 755 between the outer and inner jaws 754, 756. A detent arrangement 770 is provided on opposing surfaces of the tongue portion 766 and the outer or inner jaw 754, 756 (surface 767 of the tongue portion 766 and surface 757 of the inner jaw 756 in the embodiment illustrated in FIGS. 7A and 7B), which operatively retain the selected tongue insertion depth. The detent arrangement 770 includes a plurality of laterally extending grooves 772 on surface 757 of the inner jaw 756, which presents a plurality of predetermined tongue insertion depths, and at least one laterally extending rib 774 on surface 767 of the tongue portion 766 adjacent the free end thereof, which engages at least a selected one of the grooves 772. The detent arrangement, in other embodiments, may include a plurality of laterally extending grooves on the inner surface of the tongue portion and two laterally extending ribs on the inner surface of the inner jaw adjacent the free end thereof. One of ordinary skill in the art will of course recognize that the detent arrangement can have any suitable structure or arrangement that is capable of retaining the selected tongue insertion depth. As illustrated in FIG. 7B, one or more screw fasteners 778 can be used to prevent the tongue portion 766 from slipping out of position within the jaws 754, 756 after the tongue insertion depth has been selected. The screw fasteners 778 can be positioned within a groove 776 formed in surface 755 of the outer jaw 754.

Figure 8A:
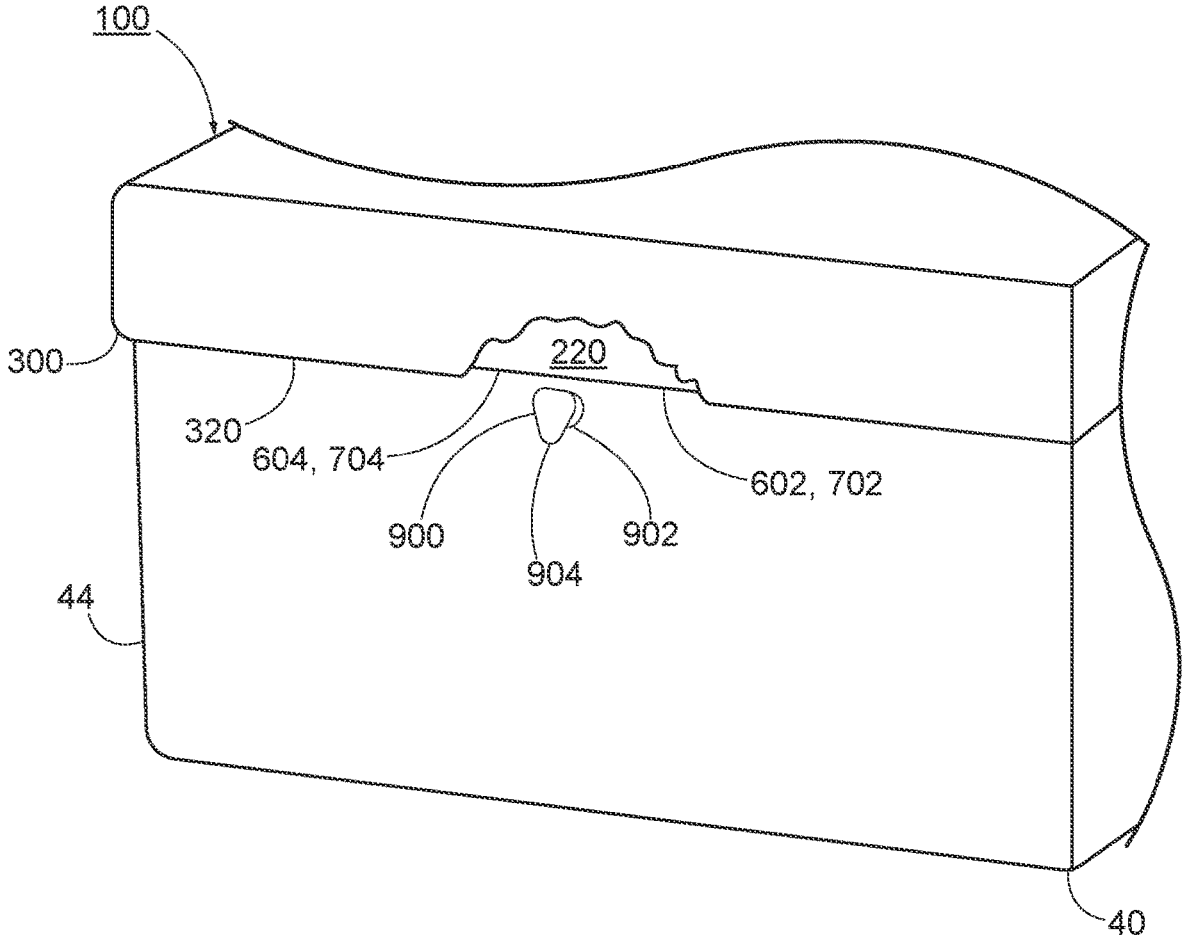
FIGS. 8A and 8B are top perspective views of a portion of the rolling cover and spa illustrating an embodiment of an optional lever latch lock, which is coupled to the end panel of the spa cabinet. A portion of end skirt 320 is cutaway in FIGS. 8A and 8B to reveal the lever latch assembly.
Figure 8B:
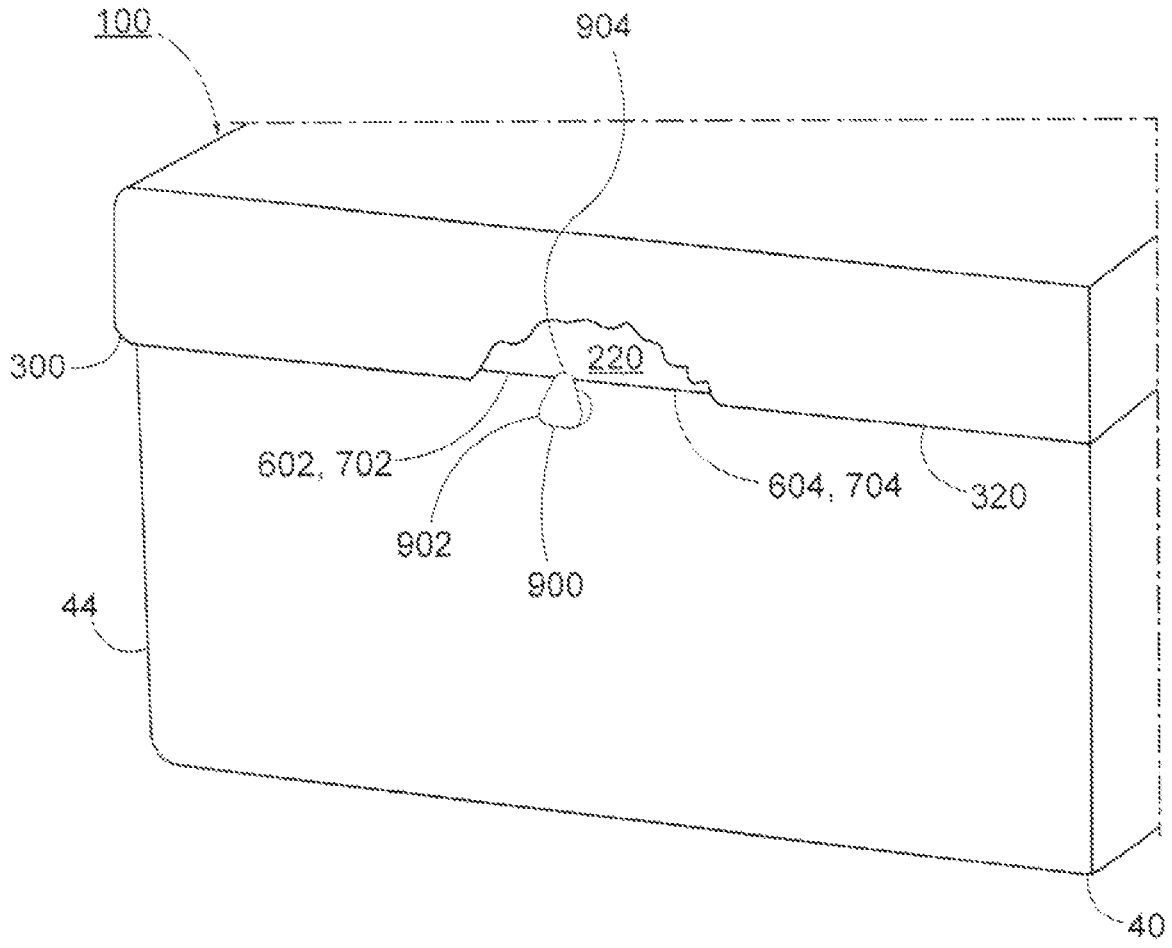

FIGS. 8A and 8B illustrate an optional lever latch lock 900, which is coupled to each of the end panels 44 of the spa cabinet 40. Each lever latch lock 900 can include a knob 902 having a projection 904. If the knob 902 is rotated into an unlocked position where the projection 904 points down and out of the way of the lever latch assembly 602, 702 of the rolling cover 100, as illustrated in FIG. 8A, the lever latch assembly 602, 702 can be freely pivoted to couple and uncouple it from the latch keeper 680 (FIG. 9A) or the bottom facing edge 38 of the sidewall 36 of the rim 32 of the spa shell 30. If the knob 902 is rotated to a locked position wherein the projection 904 of the knob 902 points up and blocks the first end 604, 704 of the lever latch assembly 602, 702 of the rolling cover 100, as shown in FIG. 8B, the projection 904 of the knob 902 will prevent the lever latch assembly 602, 702 from freely pivoting and becoming uncoupled from the latch keeper 680 or the bottom facing edge 38 of the sidewall 36 of the rim 32 of the spa shell 30. The end skirts 320 can be sized to fully reveal the lever latch locks or at least partially cover the lever latch locks 900 in the locked position to keep the end skirts 320 neatly tucked in toward the end panels 44 of the spa cabinet 40 (not shown).

Operation

The rolling cover 100 is typically installed in the rolled-up configuration by placing it on the rim 32 of the spa shell 30 at a first end of the spa 20. The rolling cover 100 is then unrolled over the shell 30 towards a second end of the spa 20. In the unrolled configuration, the insulation bag 400 and the bag support ribs 422 extend across the opening 31 of the spa shell 30 and the end and side margins of the insulation bag 400 and the ends of the bag support ribs 422 lie on the rim 32 of the spa shell 30. Because the fasteners 426 hold the insulation bag 400 up against the bag support ribs 422, the insulation bag 400 does not float on the water in the spa shell 30. After unrolling the rolling cover 100, the levers 602, 702 of the cover tightening arrangement hang down from their corresponding extensions 220 of the covering 210.

Figure 9A:
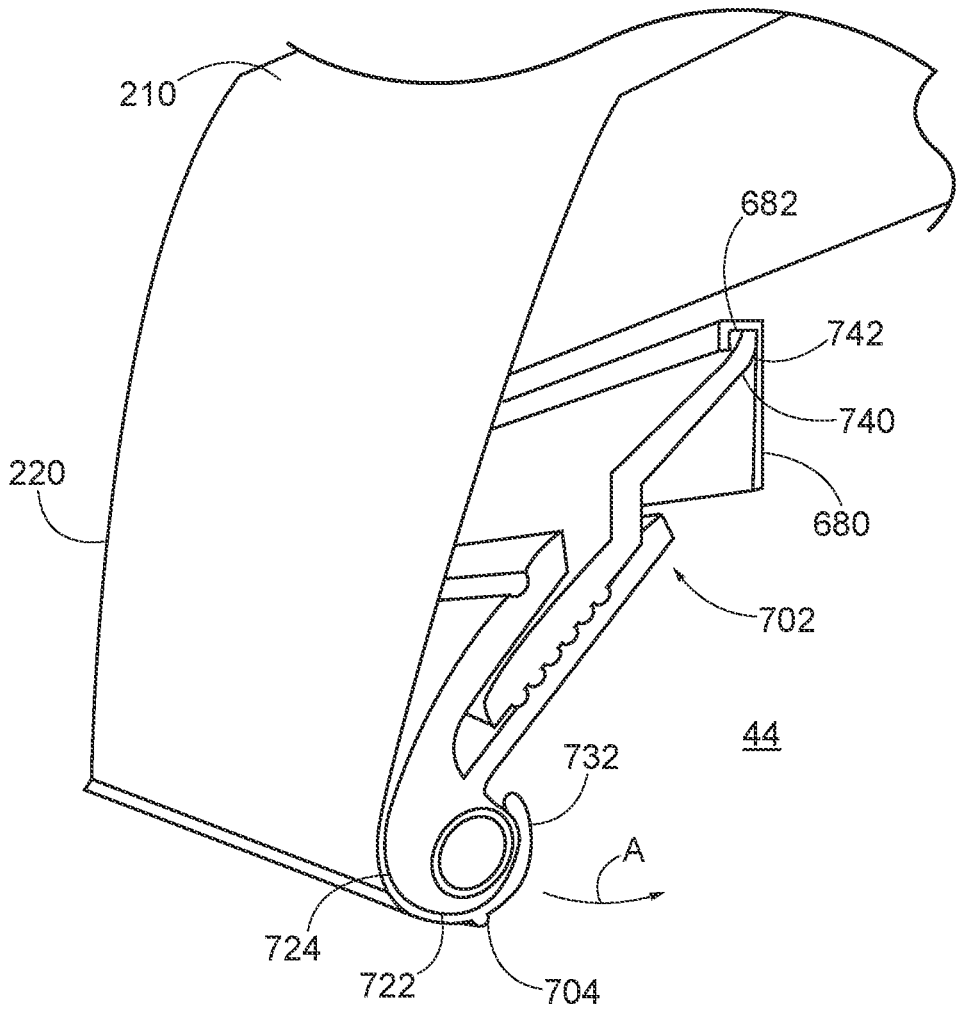
FIGS. 9A and 9B are bottom perspective views illustrating the operation of the lever latch assembly of the rolling cover.
Figure 9B:
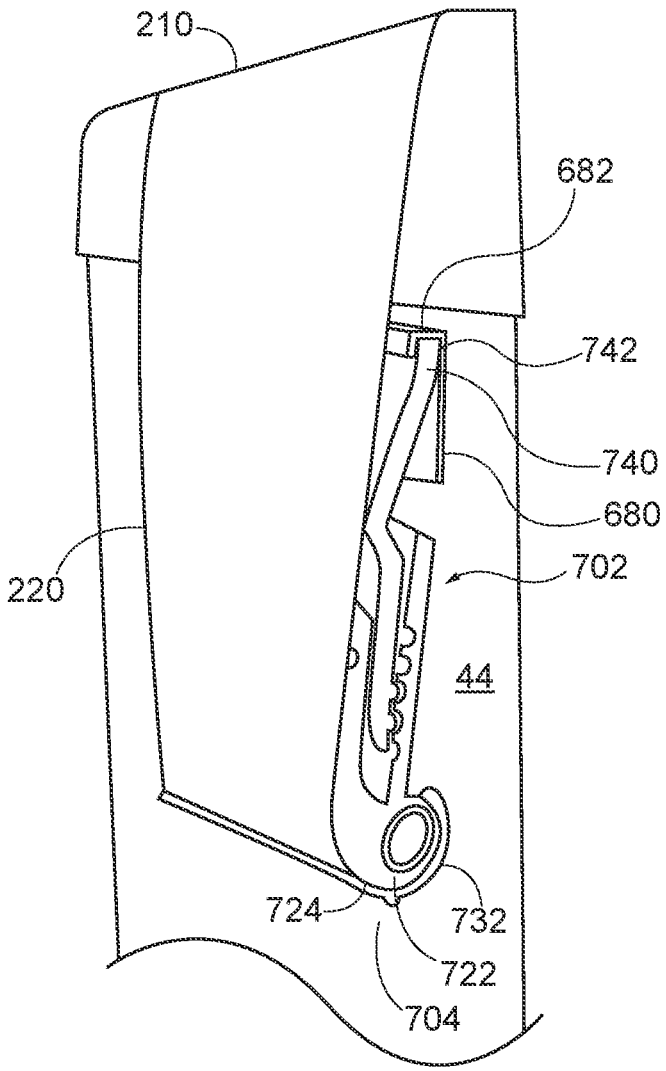

FIGS. 9A and 9B illustrate the operation of the cover tightening arrangement using the lever latch assembly 702 illustrated in FIGS. 7A and 7B. It should be understood, however, that the following description is also applicable to the lever latch assembly 602 illustrated in FIGS. 6A-6C. As shown in FIG. 9A, after the rolling cover 100 has been unrolled, each lever latch assembly 702 of the cover tightening arrangement is rotated inwardly to wrap the extension 220 of the top cover covering 210 against the bullnose surface 724 of the coupling member 722. Then, with the lever latch assembly 702 angled as shown in FIG. 9A, the flared lip 742 of the pivot latch 740 is inserted into the channel 682 of the latch keeper 680 and the first end of the lever latch assembly 702 is pivoted down in the direction of arrow A toward the end panel 44 of the spa cabinet so that the lever latch assembly 702 is generally parallel with the end panel 44, as illustrated in FIG. 9B. In embodiments that do not use the latch keeper 680, the flared lip 742 of the pivot latch 740 is the placed against the bottom facing edge 38 of the sidewall 36 of the rim 32 of the spa shell 30 (FIG. 1) and the first end of the lever latch assembly 702 is pivoted toward the end panel 44 of the spa cabinet 40 so that the lever latch assembly 702 is generally parallel with the end panel 44. As the lever latch assemblies 702 of the tightening arrangement are pivoted down, they pull the extensions 220 down, thereby tightening and making the covering 210 of the top cover 200 of the rolling cover 100 taught. The knobs 902 of the lever latch locks 900 are then rotated to the locked position to block the lever latch assemblies 702 of the rolling cover 100, as shown in FIG. 8B.

The catch members 438 of the cover straps 436 (FIGS. 3B and 4F) can be coupled to corresponding catch members 46 disposed on the side panels 42 of the spa cabinet 40 (FIG. 1) to secure the rolling cover 100 to the spa 20 either after or before the latch lever assemblies are used to tightening the covering 210 of the top cover 200 of the rolling cover 100.

The lever latch assembly 702 can be uncoupled from the latch keeper 680 or the bottom facing edge 38 of the sidewall 36 of the rim 32 of the spa shell 30 by rotating the knob 902 of the lever latch lock 900 to the unlocked position (FIG. 8A), grasping the gripping clip 732 of the latch lever assembly cover coupler 720, rotating the latch lever assembly 702 in the direction opposite to arrow A (FIG. 9A) and withdrawing the flared lip 742 of the pivot latch 740 from the channel 682 of the latch keeper 680 or bottom facing edge 38 of the sidewall 36 of the rim 32 of the spa shell 30.

It should be understood that the invention is not limited to the embodiments illustrated and described herein. Rather, the appended claims should be construed broadly to include other variants and embodiments of the invention, which may be made by those skilled in the art without departing from the scope and range of equivalents of the invention.

What is claimed is:

1. A rolling cover for use with a spa or a pool, the spa or the pool having a water holding receptacle, the rolling cover comprising:

a top cover comprising a flexible covering having extensions at opposing ends thereof;

a flexible insulation bag coupled to the flexible covering; and a cover tightening arrangement including a lever latch assembly coupled to a free end of each of the extensions, the lever latch assemblies for tightening the covering of the top cover;

wherein each of the lever latch assemblies includes a coupling member and a lever arm extending from the coupling member, the lever arm having first and second sections which are movable relative to one another for adjusting a length of the lever latch assembly;

wherein one of the first and second sections includes a tongue portion and the other one of the first and second sections includes opposing jaw members for clamping the tongue therebetween once the length of the lever latch assembly has been selected, to prevent relative movement between the first and second sections; and wherein the opposing jaw members of the other one of the first and second sections extend from the coupling member and are unitary therewith.

2. The rolling cover of claim 1, wherein the cover tightening arrangement further includes a latch keeper for coupling to the spa or the pool, the lever latch assembly operatively engaging the latch keeper to tighten the covering of the top cover.

3. The rolling cover of claim 1, further comprising a skirt coupled to the top cover, the skirt covering the lever latch assemblies and ends of a plurality of bag support ribs.

4. The rolling cover of claim 1, further comprising lever latch locks for coupling to the spa or the pool, each of the lever latch locks movable between a first position and a second position, the lever lock in the first position allowing a corresponding one of the lever latch assemblies to be freely pivoted to couple or uncouple the lever latch assembly to and from the spa or the pool, each of the lever latch locks in the second position preventing the corresponding lever latch assembly from freely pivoting once the lever latch assembly has been coupled to the spa, the hot, or the pool.

5. The rolling cover of claim 1, wherein each of the lever latch assemblies includes a cover coupler for coupling the free end of the corresponding one of the extensions to the end of the lever latch assembly, and wherein the coupling member is part of the cover coupler.

6. The rolling cover of claim 5, wherein the cover coupler further includes a retaining member, the coupling member and the retaining member clamping the free end of the extension to the lever latch assembly.

7. The rolling cover of claim 5, wherein the cover coupler further includes a gripping clip to facilitate manually grasping and operating the lever latch assembly.

8. The rolling cover of claim 1, wherein the one of the first and second sections comprising the tongue portion of each of the lever latch assemblies further includes a pivot latch for detachably coupling the lever latch assembly to the spa or the pool.

9. The rolling cover of claim 8, wherein the pivot latch includes a flared lip.

10. The rolling cover of claim 1, wherein the insulation bag contains a flexible radiant barrier layer and a flexible insulation layer.

11. The rolling cover of claim 10, wherein the flexible radiant barrier layer is disposed under the flexible insulation layer, adjacent a bottom wall of the insulation bag.

12. The rolling cover of claim 1, further comprising a plurality of bag support ribs, the bag support ribs holding the insulation bag above an operating water level of the receptacle of the spa or the pool when the rolling cover is unrolled.

13. The rolling cover of claim 12, wherein the bag support ribs comprise pultrusions or extrusions.

14. The rolling cover of claim 12, wherein the bag support ribs are coupled to the insulation bag with a plurality of fasteners.

15. The rolling cover of claim 12, wherein a plurality of fasteners couple the bag support ribs to a top wall of the insulation bag.

16. The rolling cover of claim 12, further comprising a cover strap extending from each end of at least one of the bag support ribs, the cover straps for securing the rolling cover to the spa or the pool.

17. The rolling cover of claim 1, further comprising a plurality of top cover support ribs holding the top cover in a configuration that causes external debris to runoff the top cover when the rolling cover is unrolled.

18. The rolling cover of claim 17, wherein the top cover support ribs comprise pultrusions or extrusions.

19. The rolling cover of claim 17, wherein the top cover support ribs are disposed on a plurality of bag support ribs.

20. A spa comprising:

a water holding shell; and the rolling cover of claim 1, the rolling cover for covering the shell when the spa is not in use.

21. A rolling cover for use with a spa or a pool, the spa or the pool having a water holding receptacle, the rolling cover comprising:

a top cover comprising a flexible covering having extensions at opposing ends thereof;

a flexible insulation bag coupled to the flexible covering;

a plurality of bag support ribs, the bag support ribs holding the insulation bag above an operating water level of the receptacle of the spa or the pool when the rolling cover is unrolled; and a cover tightening arrangement including a lever latch assembly coupled to a free end of each of the extensions, the lever latch assemblies for tightening the covering of the top cover;

wherein each of the lever latch assemblies is adjustable in length;

wherein the bag support ribs are coupled to the insulation bag with a plurality of fasteners; and wherein the insulation bag includes a plurality of strips of flexible material coupled to and extending across an interior surface of the insulation bag, the strips of flexible material retaining a first end of each of the fasteners.

22. A rolling cover for use with a spa or a pool, the spa or the pool having a water holding receptacle, the rolling cover comprising:

a top cover comprising a flexible covering having extensions at opposing ends thereof;

a flexible insulation bag coupled to the flexible covering;

a plurality of bag support ribs, the bag support ribs holding the insulation bag above an operating water level of the receptacle of the spa or the pool when the rolling cover is unrolled; and a cover tightening arrangement including a lever latch assembly coupled to a free end of each of the extensions, the lever latch assemblies for tightening the covering of the top cover;

wherein each of the lever latch assemblies is adjustable in length;

wherein the bag support ribs are coupled to the insulation bag with a plurality of fasteners; and wherein the interior surface of the insulation bag is defined by a bottom wall of the insulation bag, the first end of each of the fasteners disposed between the interior surface of the bottom wall of the insulation bag and an associated one of a plurality of strips of flexible material.

23. A rolling cover for use with a spa or a pool, the spa or the pool having a water holding receptacle, the rolling cover comprising:

a top cover comprising a flexible covering having extensions at opposing ends thereof;

a flexible insulation bag coupled to the flexible covering;

a plurality of top cover support ribs holding the top cover in a configuration that causes external debris to runoff the top cover when the rolling cover is unrolled; and a cover tightening arrangement including a lever latch assembly coupled to a free end of each of the extensions, the lever latch assemblies for tightening the covering of the top cover;

wherein each of the lever latch assemblies is adjustable in length;

wherein the top cover support ribs are disposed on a plurality of bag support ribs; and wherein the top cover support ribs are shorter than the bag support ribs.

24. A rolling cover for use with a spa or a pool, the spa or the pool having a water holding receptacle, the rolling cover comprising:

a top cover comprising a flexible covering having extensions at opposing ends thereof;

a flexible insulation bag coupled to the flexible covering;

a plurality of top cover support ribs holding the top cover in a configuration that causes external debris to runoff the top cover when the rolling cover is unrolled;

a plurality of rib straps; and a cover tightening arrangement including a lever latch assembly coupled to a free end of each of the extensions, the lever latch assemblies for tightening the covering of the top cover;

wherein each of the lever latch assemblies is adjustable in length;

wherein the top cover support ribs are disposed on a plurality of bag support ribs; and wherein each of the rib straps extends from one of the top cover support ribs to an end of the bag support rib on which that top cover support rib is disposed, the rib straps assisting the top cover support ribs with holding the top cover in the configuration that causes external debris to runoff the top cover when the rolling cover is unrolled.

25. A rolling cover for use with a spa or a pool, the spa or the pool having a water holding receptacle, the rolling cover comprising:

a top cover comprising a flexible covering having extensions at opposing ends thereof;

a flexible insulation bag coupled to the flexible covering;

a plurality of bag support ribs, the bag support ribs holding the insulation bag above an operating water level of the receptacle of the spa or the pool when the rolling cover is unrolled;

a rib strap; and a cover tightening arrangement including a lever latch assembly coupled to a free end of each of the extensions, the lever latch assemblies for tightening the covering of the top cover;

wherein each of the lever latch assemblies is adjustable in length;

wherein the rib strap extends from a first one of the bag support ribs disposed at a first end of the insulation bag to a second one of the bag support ribs disposed at a second end wall of the insulation bag, the rib strap coupled to a plurality of top cover support ribs.

* * * * *